US008456406B2

(12) United States Patent
Nam et al.

(10) Patent No.: US 8,456,406 B2
(45) Date of Patent: Jun. 4, 2013

(54) LIQUID CRYSTAL DISPLAY AND DRIVING METHOD WITH BLACK VOLTAGE CHARGING

(75) Inventors: Hyuntaek Nam, Daegu (KR); Suhyuk Jang, Daegu (KR); Myungkook Moon, Daegu (KR); Jongwoo Kim, Gumsi-si (KR)

(73) Assignee: LG Display Co., Ltd., Seoul (KR)

( * ) Notice: Subject to any disclaimer, the term of this patent is extended or adjusted under 35 U.S.C. 154(b) by 824 days.

(21) Appl. No.: 12/314,921

(22) Filed: Dec. 18, 2008

(65) Prior Publication Data

US 2009/0213056 A1 Aug. 27, 2009

(30) Foreign Application Priority Data

Feb. 27, 2008 (KR) ..... 10-2008-0017995

(51) Int. Cl.
*G09G 3/36* (2006.01)

(52) U.S. Cl.
USPC ..... 345/100

(58) Field of Classification Search
USPC ..... 345/87–100, 103, 204, 33, 50–59; 377/64–81
See application file for complete search history.

(56) References Cited

U.S. PATENT DOCUMENTS

| | | | | |
|---|---|---|---|---|
| 7,518,587 | B2 * | 4/2009 | Lee et al. | 345/98 |
| 2006/0028463 | A1 * | 2/2006 | Nakamura et al. | 345/204 |
| 2007/0152947 | A1 * | 7/2007 | Tanaka et al. | 345/100 |

* cited by examiner

*Primary Examiner* — Liliana Cerullo
(74) *Attorney, Agent, or Firm* — McKenna Long & Aldridge LLP

(57) ABSTRACT

An impulsive driving liquid crystal display and a driving method thereof are provided. The liquid crystal display comprises a liquid crystal display panel on which a plurality of data lines and a plurality of gate lines cross each other; a data driving circuit for supplying a video data voltage and a black voltage to the data lines; and a plurality of gate drive ICs for sequentially supplying a gate pulse, synchronized with the video data voltage during a first period, to adjacent gate lines, and then simultaneously supplying a gate pulse, synchronized with the black voltage during a second period, to the gate lines spaced at intervals of at least one line.

8 Claims, 9 Drawing Sheets

| | | | | | |
|---|---|---|---|---|---|
| BL1 | BLACK CHARGING | VIDEO DATA CHARGING | DATA RETENTION | BLACK CHARGING | VIDEO DATA CHARGING |
| BL2 | DATA RETENTION | BLACK CHARGING | VIDEO DATA CHARGING | DATA RETENTION | BLACK CHARGING |
| BL3 | VIDEO DATA CHARGING | DATA RETENTION | BLACK CHARGING | VIDEO DATA CHARGING | DATA RETENTION |

LIQUID CRYSTAL DISPLAY AND DRIVING METHOD WITH BLACK VOLTAGE CHARGING

This nonprovisional application claims priority under 35 U.S.C. §119(a) on patent application Ser. No. 10-2008-0017995 filed in Republic of Korea on Feb. 27, 2008, the entire contents of which are hereby incorporated by reference.

BACKGROUND

1. Field

This document relates to an impulsive driving liquid crystal display and a driving method thereof.

2. Related Art

An active matrix driving liquid crystal display displays a moving image using thin film transistors (TFTs) as switching elements. Since the liquid crystal display can be formed into a small size compared to a cathode ray tube (CRT), it is applied to a television set as well as a display device in a portable information device, an office machine, a computer, etc., and gradually replaces the CRT.

The liquid crystal display has a motion blur phenomenon in which a picture of a moving image is blurred due to retention characteristics of the liquid crystal. As shown in FIG. 1, the CRT displays an image in an impulsive driving method, in which light is emitted from a fluorescent material for a very short time to display data in a cell and then light is not emitted from the cell any more. Compared to this, as shown in FIG. 2, the liquid crystal display displays an image in a hold-type driving method, in which data is supplied to a liquid crystal cell during a scanning period and then the data charged in the liquid crystal cell is maintained for the remaining field period (or frame period).

Since the moving image is displayed on the CRT in the impulsive driving method, the image perceived by a viewer becomes clear as shown in FIG. 3. On the contrary, as shown in FIG. 4, in the moving image displayed on the liquid crystal display, the image perceived by the viewer is blurred due to the retention characteristics of the liquid crystal. The difference in perceived images results from an integration effect of the image that continues temporarily in the viewer's eyes that follow the movement. Accordingly, even though the response speed of the liquid crystal display is high, the viewer sees a blurred image by discordance between the movement of eyes and a static image for each frame. In order to improve the motion blur phenomenon, the impulsive driving method that inserts black data after displaying video data on a screen, i.e., a black data insertion (BDI) method is proposed. For example, as shown in FIG. 5, according to the black data insertion method, a screen is divided into three blocks, a video data voltage is sequentially charged in each line in one of the divided blocks A1, and a black voltage is simultaneously charged in adjacent four lines in the other block A2. In the this manner, the black data insertion method accomplishes an impulsive driving effect by sequentially charging video data lines in the respective blocks A1 to A3 and then sequentially applying a black voltage to four lines. In order to simultaneously select the lines in which the black voltage is charged, a gate drive IC simultaneously applies gate pulses to adjacent gate lines. However, when a control signal for simultaneously applying the gate pulses to adjacent gate lines is applied to the gate drive IC, the gate drive IC may not generate an output or malfunction according to the kind thereof.

SUMMARY

The Exemplary embodiments have been made in an effort to provide a liquid crystal display and a driving method thereof, which can simultaneously supply a gate pulse to at least two gate lines in a block, in which a black voltage is charged, even if any gate drive IC is used.

An aspect of this document is to provide a liquid crystal display comprising: a liquid crystal display panel on which a plurality of data lines and a plurality of gate lines cross each other; a data driving circuit for supplying a video data voltage and a black voltage to the data lines; and a plurality of gate drive ICs for sequentially supplying a gate pulse, synchronized with the video data voltage during a first period, to adjacent gate lines, and then simultaneously supplying a gate pulse, synchronized with the black voltage during a second period, to the gate lines spaced at intervals of at least one line.

Another aspect of this document is to provide a method of driving a liquid crystal display comprising a liquid crystal display panel on which a plurality of data lines and a plurality of gate lines cross each other, the method comprising: supplying a video data voltage and a black voltage to the gate lines; sequentially supplying a gate pulse, synchronized with the video data voltage and the black voltage, to adjacent gate lines during a first period; and simultaneously supplying a gate pulse, synchronized with the black voltage, to the gate lines spaced at intervals of at least one line during a second period.

BRIEF DESCRIPTION OF THE DRAWINGS

The implementation of this document will be described in detail with reference to the following drawings in which like numerals refer to like elements.

DETAILED DESCRIPTION

Hereinafter, an implementation of this document will be described in detail with reference to FIGS. 6 to 13.

Figure 1:
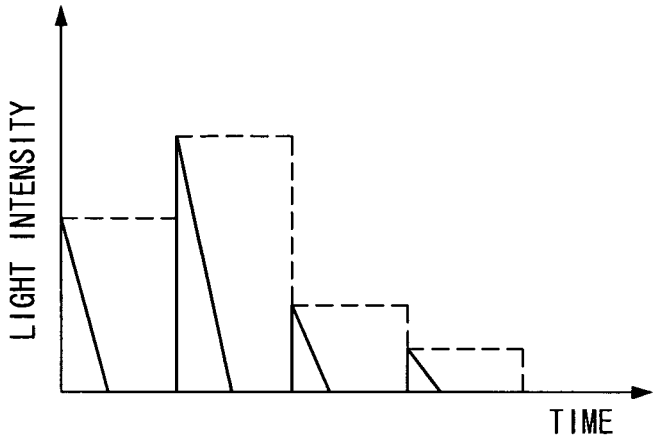
FIG. 1 (Related art)
FIG. 1 is a characteristic diagram showing emission characteristics of a cathode ray tube.
Figure 2:
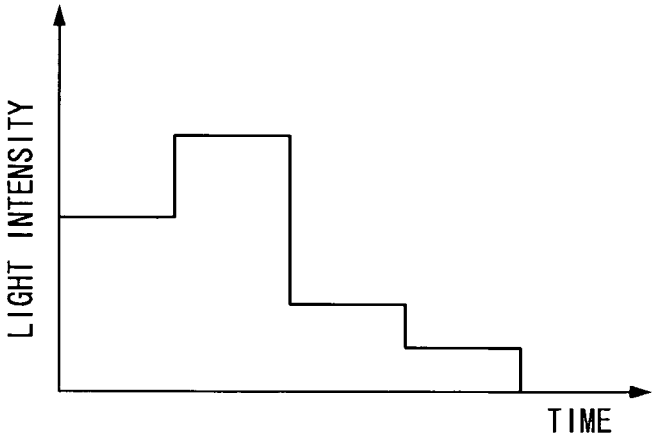
FIG. 2 (Related art)
FIG. 2 is a characteristic diagram showing retention characteristics of a liquid crystal display.
Figure 3:
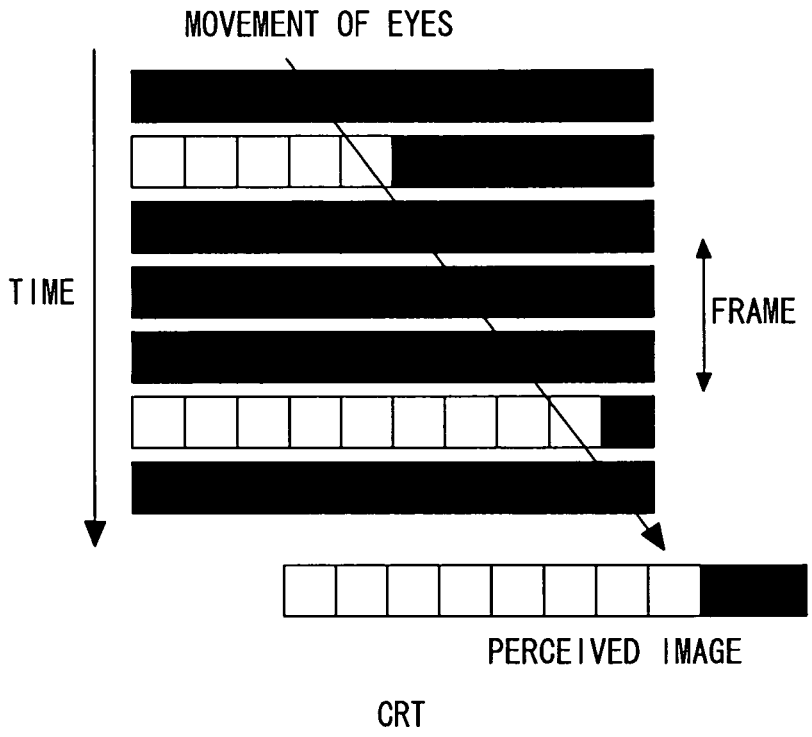
FIG. 3 (Related art)
FIG. 3 is a diagram showing an image of a cathode ray tube perceived by a viewer.
Figure 4:
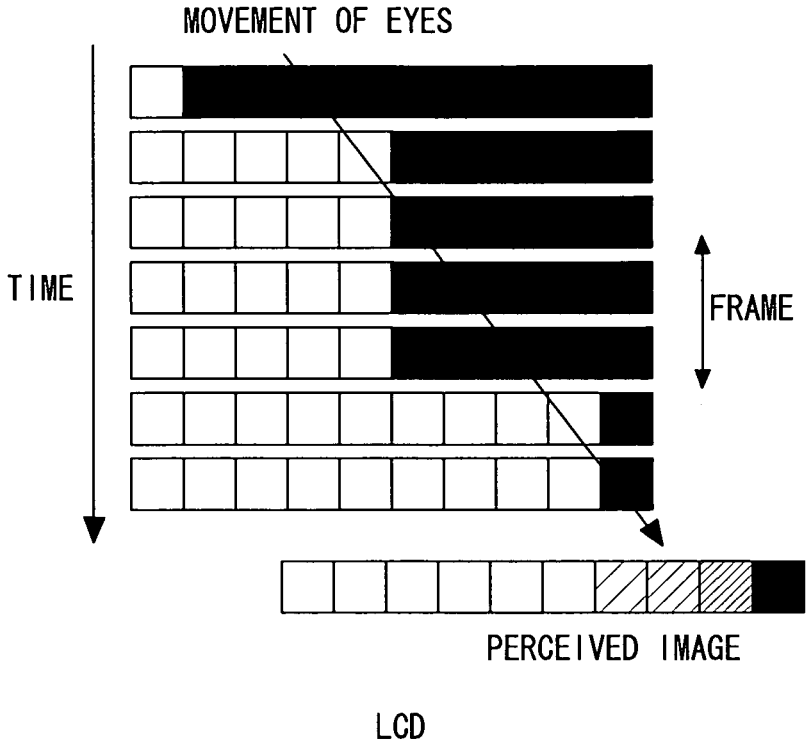
FIG. 4 (Related art)
FIG. 4 is a diagram showing an image of a liquid crystal display perceived by a viewer.
Figure 5:
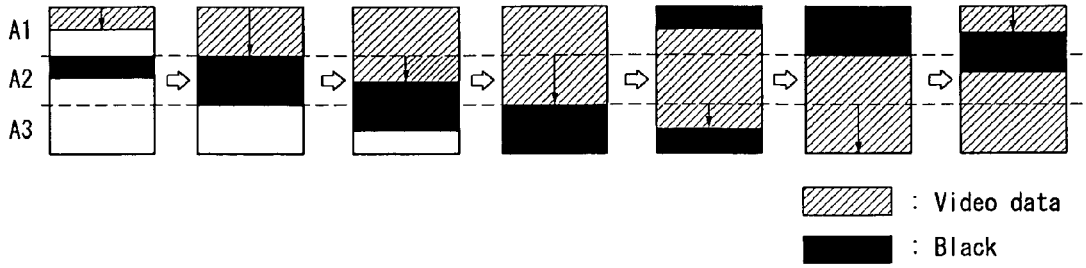
FIG. 5 (Related art)
FIG. 5 is a diagram showing a scanning operation of a video data voltage and a black voltage in a black data insertion method.
Figure 6:
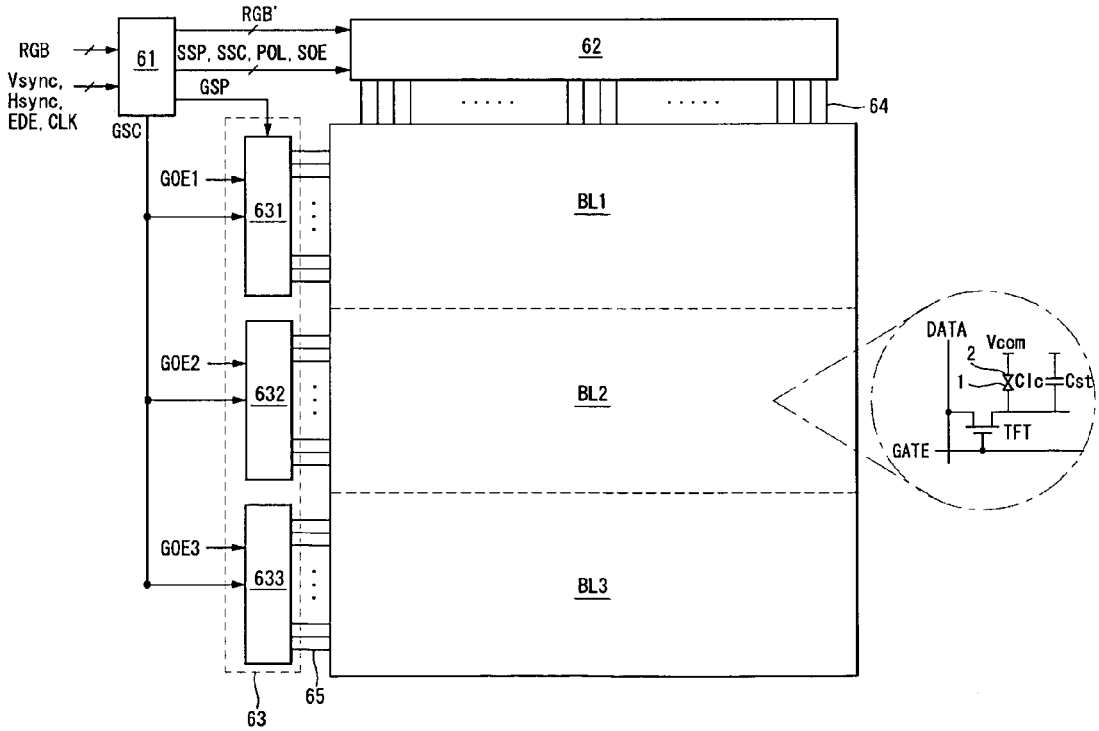
FIG. 6 is a block diagram showing a liquid crystal display according to an exemplary embodiment.

Referring to FIG. 6, a liquid crystal display according to an exemplary embodiment comprises a liquid crystal display panel, a timing controller 61, a data driving circuit 62, and a gate driving circuit 63. The data driving circuit 62 comprises a plurality of source drive ICs. The gate driving circuit 63 comprises a plurality of gate drive ICs 631 to 633.

The liquid crystal display panel comprises a liquid crystal layer interposed between two glass substrates. The liquid crystal display panel comprises m×n number of liquid crystal cells Clc arranged in a matrix form defined by m number of data lines 64 and n number of gate lines 65, which cross each other.

The data lines 64, the gate lines 65, thin film transistors (TFTs), and storage capacitors Cst are formed on a lower glass substrate of the liquid crystal display panel. Each liquid crystal cell Clc is connected to the TFT and driven by an electric field between a pixel electrode 1 and a common electrode 2. A black matrix, a color filter, and the common electrode are formed on an upper glass substrate of the liquid crystal display panel. The common electrode 2 is formed on the upper glass substrate in a vertical electric field driving configuration such as a twisted nematic (TN) mode and a vertical alignment (VA) mode. Alternatively, the common electrode 2 is formed on the lower glass substrate together with the pixel electrode 1 in a horizontal electric field driving configuration such as an in-plane switching (IPS) mode and a fringe field switch (FFS) mode. Polarizers are disposed on the respective upper and lower glass substrates of the liquid crystal display panel, and alignment films for setting a pre-tilt angle of the liquid crystal are provided.

A display screen of the liquid crystal display panel is divided into a plurality of blocks BL1 to BL3 and driven by gate timing control signals applied to the gate drive ICs 631 to 633. Each of the blocks BL1 to BL3 is time-divided into a video data charging period, in which a video data voltage is charged in each line, a data retention period, in which the data voltage is maintained, and a black charging period, in which a black voltage is charged in at least two lines spaced at intervals of at least one line. Here, the lines represent pixel rows.

The timing controller 61 receives timing signals, such as vertical/horizontal synchronization signals Vsync and Hsync, an external data enable signal EDE, and a dot clock CLK, and generates control signals for controlling operation timings of the data driving circuit 62 and the gate driving circuit 63. The control signals comprise gate timing control signals and data timing control signals. Moreover, the timing controller 61 supplies digital video data RGB to the data driving circuit 62.

The gate timing control signals comprise a gate start pulse GSP, a gate shift clock GSC, and gate output enable signals GOE1 to GOE3. The gate start pulse GSP is applied to the first gate drive IC 631 and indicates a start line from which the scanning starts so that a first gate pulse is generated from the first gate drive IC 631. In the liquid crystal display and the driving method thereof according to the exemplary embodiment, the number and interval of the gate start pulses GSP generated during the data charging period are different from those of the gate start pulses GSP generated during the black charging period. During the data charging period, the gate start pulse GSP is generated with a pulse width corresponding to about one horizontal period one time so that the gate pulses are sequentially supplied from the gate drive ICs 631 to 633 to each line. During the black charging period, the gate start pulse GSP is generated more than two times at an interval corresponding to about one horizontal period so that the gate pulses are simultaneously supplied from the gate drive ICs 631 to 633 to at least two gate lines spaced at intervals of at least one line. Each pulse width of the gate start pulse GSP generated during the black charging period corresponds to about one horizontal period. The gate shift clock GSC is a clock signal for shifting the gate start pulse GSP. Shift resistors of the gate drive ICs 631 to 633 shift the gate start pulse GSP at a rising edge of the gate shift clock GSC. The second and third gate drive ICs 632 and 633 receive a carry signal from the previous gate drive ICs as a gate start pulse and start operating. The gate output enable signals GOE1 to GOE 3 are respectively applied to the gate drive ICs 631 to 633. The gate drive ICs 631 to 633 output the gate pulses during a low logic period (at a low logic level) of the gate output enable signals GOE1 to GOE 3, i.e., for a period from the falling edge of the previous pulse to the rising edge of the next pulse. During a high logic period (at a high logic level) of the gate output enable signals GOE1 to GOE 3, the gate drive ICs 631 to 633 do not generate a gate pulse. The low logic period of the gate output enable signals GOE1 to GOE3 is at least three times longer than the high logic period during the data charging period so that the gate pulses are sequentially supplied to at least three gate lines. On the contrary, the high logic period of the gate output enable signals GOE1 to GOE 3 is more than three times longer than the low logic period during the black charging period so as to cut off the data voltages supplied to the blocks in which the data is charged. As a result, the gate output enable signals GOE1 to GOE 3 generated during the data charging period have a duty ratio smaller than that of the gate output enable signals GOE1 to GOE 3 generated during the black charging period and have a phase opposite to that of the gate output enable signals GOE1 to GOE 3 generated during the black charging period.

The data timing control signals comprise a source start pulse SSP, a source sampling clock SSC, a polarity control signal POL, and a source output enable signal SOE. The source start pulse SSP indicates a start pixel in a first horizontal line in which data is to be displayed. The source sampling clock SSC indicates a latching operation of data in the data driving circuit 62 based on a rising or falling edge. The polarity control signal POL controls the polarity of an analog video data voltage output from the data driving circuit 62. The source output enable signal SOE controls the output of the data driving circuit 62.

Each of the data drive ICs of the data driving circuit 62 comprises a shift resistor, a latch circuit, a digital-to-analog converter, and an output buffer. The data driving circuit 62 latches digital video data RGB' under the control of the timing controller 61. The data driving circuit 62 converts the digital video data RGB' into an analog positive/negative gamma compensation voltage in accordance with the polarity control signal POL to generate a positive/negative analog data voltage, thereby supplying the data voltage to the data lines 64 when the blocks, which operate during the data charging period and the data retention period, are scanned. Moreover, the data driving circuit 62 generates a black voltage and supplies it to the data lines when the blocks, which operate during the black charging period, are scanned. The black voltage is the lowest gradation among all gradations of the data displayed on the liquid crystal cells Clc, i.e., a data voltage of black gradation. The black voltage can be generated in various ways. For example, digital black data is generated by the timing controller 61 or from the outside, and the data driving circuit 62 converts the digital black data into a positive/negative gamma compensation voltage, thus generating a black voltage to be supplied to the data lines 64. In the meanwhile, as disclosed in Korean Patent Application No. 10-2007-0127758, filed by the applicant, a charge share voltage or a pre-charge voltage generated from the data driving circuit 62 may be used instead of the black voltage.

Each of the gate drive ICs 631 to 633 sequentially supplies the gate pulses to the gate lines 65 in response to the gate timing control signals. The configuration of the gate drive ICs is as shown in FIG. 7.

Figure 7:
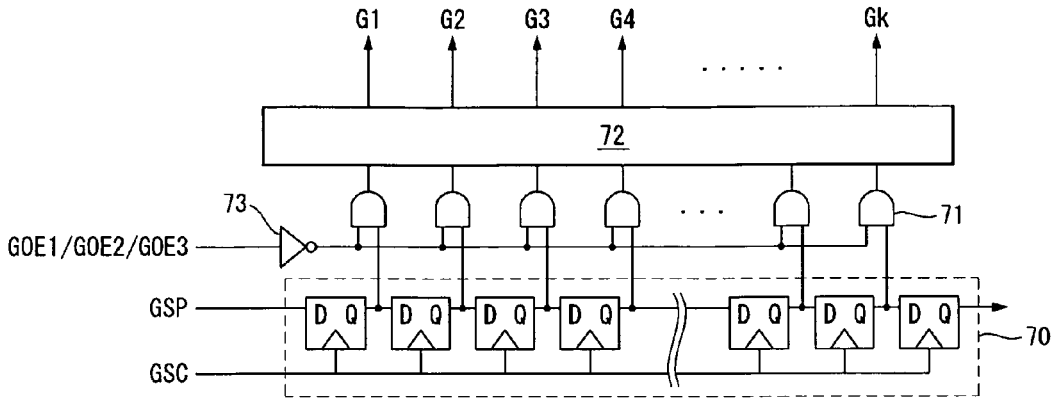
FIG. 7 is a circuit diagram showing a gate drive IC of FIG. 6.

FIG. 7 shows the gate drive ICs 631 to 633.

Referring to FIG. 7, each of the gate drive ICs 631 to 633 comprises a shift resistor 70, a level shifter 72, a plurality of AND gates 71 connected between the shift resistor 70 and the level shifter 72, and an inverter 73 for inverting the gate output enable signals GOE1 to GOE3.

The shift resistor 70 sequentially shifts the gate start pulse GSP in accordance with the gate shift clock GSC using a plurality of serially connected D flip-flops. Each of the AND gates 71 generates an output by logically ANDing an output signal of the shift resistor 70 with inverted signals of the gate output enable signals GOE1 to GOE3. The inverter 73 inverts the gate output enable signals GOE1 to GOE3 and supplies the inverted signals to the AND gates 71. As a result, the gate drive ICs 631 to 633 generate an output only when the gate output enable signals GOE1 to GOE3 are at a low logic level.

The level shifter 72 shifts a swing width of an output voltage of each AND gate 71 to a range suitable for driving the TFT of the liquid crystal display panel. Output signals G1 to Gk of the level shifter 72 are sequentially supplied to k number of gate lines (wherein k is an integer). Meanwhile, the level shifter 72 may be disposed in front of the shift resistor 70, and the shift resistor 70 may be directly formed on the glass substrate of the liquid crystal panel together with the TFTs of the pixel array.

The liquid crystal display according to the exemplary embodiment applies the video data to three lines in the block, in which the video data voltage is charged, and simultaneously applies the black voltage to at least two lines spaced at intervals of at least one line in the block, in which the black voltage is charged, during a period in which data is loaded into three lines in a conventional liquid crystal display. For this purpose, the liquid crystal display according to the exemplary embodiment should increase the transfer frequency of the digital video data transferred to the data driving circuit 62 and increase the operation timings of the data driving circuit 62 and the gate driving circuit 63 using the timing controller 61 as shown in FIG. 8.

Figure 8:
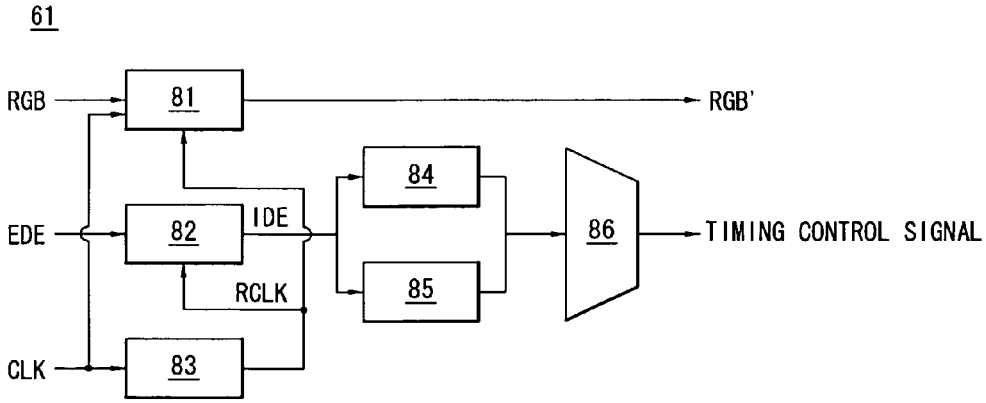
FIG. 8 is a block diagram showing a timing controller of FIG. 6.

FIG. 8 shows the data processing and the timing control signal processing of the timing controller 61.

Referring to FIG. 8, the timing controller 61 comprises a memory 81, an internal data enable signal generator 82, a read clock generator 83, a signal generator 84 for black data, a signal generator 85 for video data, and a selector 86.

The memory 81 comprises three line memories to store digital video data of three lines. The memory 81 outputs the stored digital video data RGB' in response to a read clock RCLK generated from the read clock generator 83. The internal data enable signal generator 82 counts a read clock RCLK of an external data enable signal EDE and generates an internal data enable signal IDE for indicating an effect data period for each line. Since the frequency of the read clock RCLK is increased by the read clock generator 83, the internal data enable signal IDE having a frequency higher than that of the external data enable signal EDE is generated.

The read clock generator 83 receives a dot clock CLK and generates a read clock RCLK having a frequency higher than that of the dot clock CLK. For example, the read clock generator 83 can generate a read clock RCLK by increasing the frequency of the dot clock CLK 4/3 times. When the frequency of the read clock RCLK is increased 4/3 times that of the dot clock CLK, the read clock generator 83 generates an internal data enable signal IDE by generating four pulses during a period in which three pulses are present in the external data enable signal EDE. In this case, the memory 81 outputs digital video data RGB' synchronized with the internal data enable signal IDE in response to the read clock RCLK having a frequency three times higher than that of the dot clock CLK, thus increasing the transfer frequency of the digital video data RGB' supplied to the data driving circuit 62.

The signal generator 84 for black data generates data timing control signals for controlling the data driving circuit 62 and gate timing control signals for controlling the gate driving circuit 63 in response to the internal data enable signal IDE during the black charging period. The signal generator 85 for video data generates data timing control signals for controlling the data driving circuit 62 and gate timing control signals for controlling the gate driving circuit 63 in response to the internal data enable signal IDE during the data charging period. A portion of the data timing control signals, generated during the black charging period, e.g., the source output enable signal SOE, may have a duty ratio greater than that generated during the data charging period. The number of gate start pulses GSP among the gate timing control signals, generated during the black charging period, is increased compared to that generated during the data charging period. Moreover, the gate output enable signals GOE1 to GOE 3 among the gate timing control signals, generated during the black charging period, have a phase opposite to that of the gate output enable signals GOE1 to GOE3 generated during the data charging period.

The selector 86 selects the output of the signal generator 84 for black data during the black charging period and selects the output of the signal generator 85 for video data during the data charging period. The selector 86 may be implemented with a multiplexer.

Figure 9:
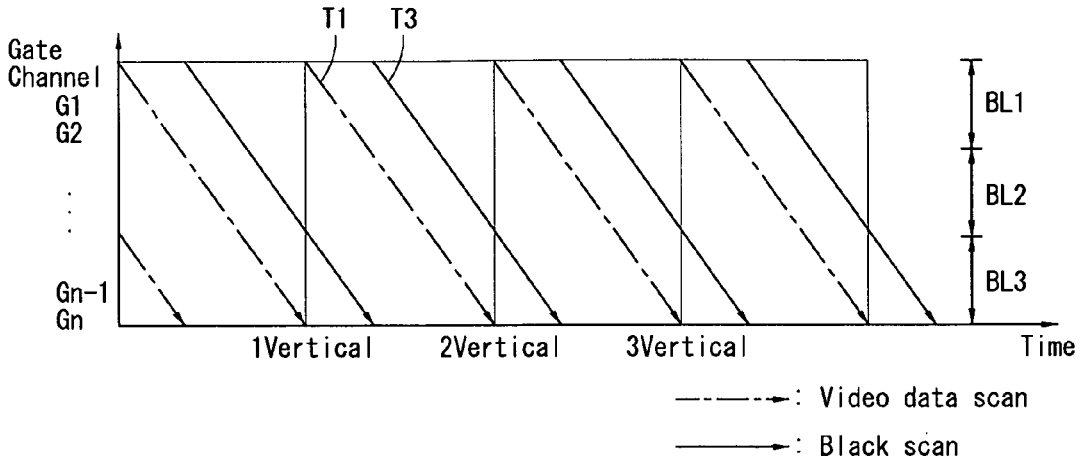
FIG. 9 is a diagram showing a scanning operation of video data and black data in the liquid crystal display according to the exemplary embodiment.
Figure 10:
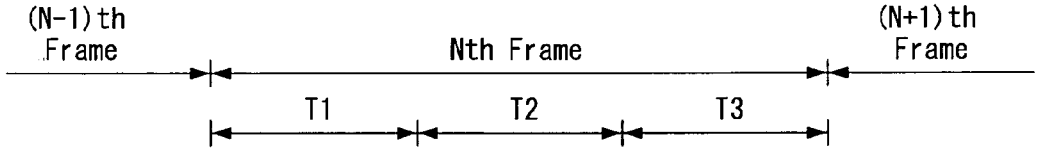
FIG. 10 is a diagram showing the operation of respective blocks in the liquid crystal display according to the exemplary embodiment.

FIGS. 9 and 10 are diagrams showing the scanning operation of video data and black data in the liquid crystal display according to the exemplary embodiment.

Referring to FIGS. 9 and 10, each of the blocks BL1 to BL3 is time divided into a video data charging period, a data retention period, and a black charging period.

During period T1, the first gate drive IC 631 starts operating due to the gate start pulse GSP, which is generated only one time simultaneously with the start of period T1, and repeats the operations of sequentially supplying gate pulses to i number of gate lines (wherein i is an integer greater than three), stopping the output during one horizontal period, and then sequentially supplying the gate pulses to the gate lines. During period T1, the video data voltage from the data driving circuit 62 is sequentially applied to each line of the liquid crystal cells in the first block BL1 scanned by the first gate drive IC 631. The second gate drive IC 632 receives a carry signal from the first gate drive IC 631 simultaneously with the start of period T1. The carry signal corresponds to the carry signal generated by shifting the gate start pulse GSP applied to the first gate drive IC 631 during period T3 of the previous frame and corresponds to a gate start pulse GSP of the second gate drive IC 632. The black voltage from the data driving circuit 62 is sequentially applied to at least two lines spaced at intervals of at least one line of the liquid crystal cells in the second block BL2 scanned by the second gate drive IC 632. Immediately after the video data voltage is sequentially applied to i number of lines of the first block BL1 during one horizontal period, the operation of simultaneously applying the black voltage to at least two lines spaced at intervals of at least one line of the second block BL2 is repeated during one horizontal period. During period T1, the third gate drive IC 633 does not receive a carry signal from the second gate drive IC 632. The third block BL3 maintains the video data voltage charged during period T3 of the previous frame.

During period T2, the first gate drive IC 631 does not receive a gate start pulse GSP from the timing controller 61. Since the first gate drive IC 631 cannot perform the shift operation, it cannot output a gate pulse during period T2. As a result, the first block BL1 maintains the video data voltage charged during period T1. The second gate drive IC 632 receives a carry signal from the first gate drive IC 631 simultaneously with the start of period T2. The carry signal corresponds to the carry signal generated by shifting the gate start pulse GSP applied to the first gate drive IC 631 during period T3 of the previous frame and corresponds to the gate start pulse GSP of the second gate drive IC 632. The video data voltage from the data driving circuit 62 is sequentially applied to each line of the liquid crystal cells in the second block BL2 scanned by the second gate drive IC 632. The third gate drive IC 633 receives a carry signal from the second gate drive IC 632 simultaneously with the start of period T3. The carry signal corresponds to the carry signal generated by shifting the gate start pulse GSP applied to the second gate drive IC 632 during period T1 and corresponds to a gate start pulse GSP of the third gate drive IC 633. The black voltage from the data driving circuit 62 is sequentially applied to at least two lines spaced at intervals of at least one line of the liquid crystal cells in the third block BL3 scanned by the third gate drive IC 633. Immediately after the video data voltage is sequentially applied to i number of lines of the second block BL2 during one horizontal period, the operation of simultaneously applying the black voltage to at least two lines spaced at intervals of at least one line of the third block BL3 is repeated during one horizontal period.

Simultaneously with the start of period T3, the first gate drive IC 631 receives the gate start pulses GSP generated from the timing controller 61 more than three times consecutively. The black voltage from the data driving circuit 62 is sequentially applied to at least two lines spaced at intervals of at least one line of the liquid crystal cells in the first block BL1 scanned by the first gate drive IC 631. During period T3, the second gate drive IC 632 does not receive a carry signal from the first gate drive IC 631. Since the second gate drive IC 632 cannot perform the shift operation, it cannot output a gate pulse during period T3. As a result, the second block BL2 maintains the video data voltage charged during period T2. The third gate drive IC 633 receives a carry signal from the second gate drive IC 632 simultaneously with the start of period T3. The carry signal corresponds to the carry signal generated by shifting the gate start pulse GSP applied to the second gate drive IC 632 during period T2 and corresponds to the gate start pulse GSP of the third gate drive IC 633. The video data voltage from the data driving circuit 62 is sequentially applied to each line of the liquid crystal cells in the third block BL3 scanned by the third gate drive IC 633.

Figure 11:
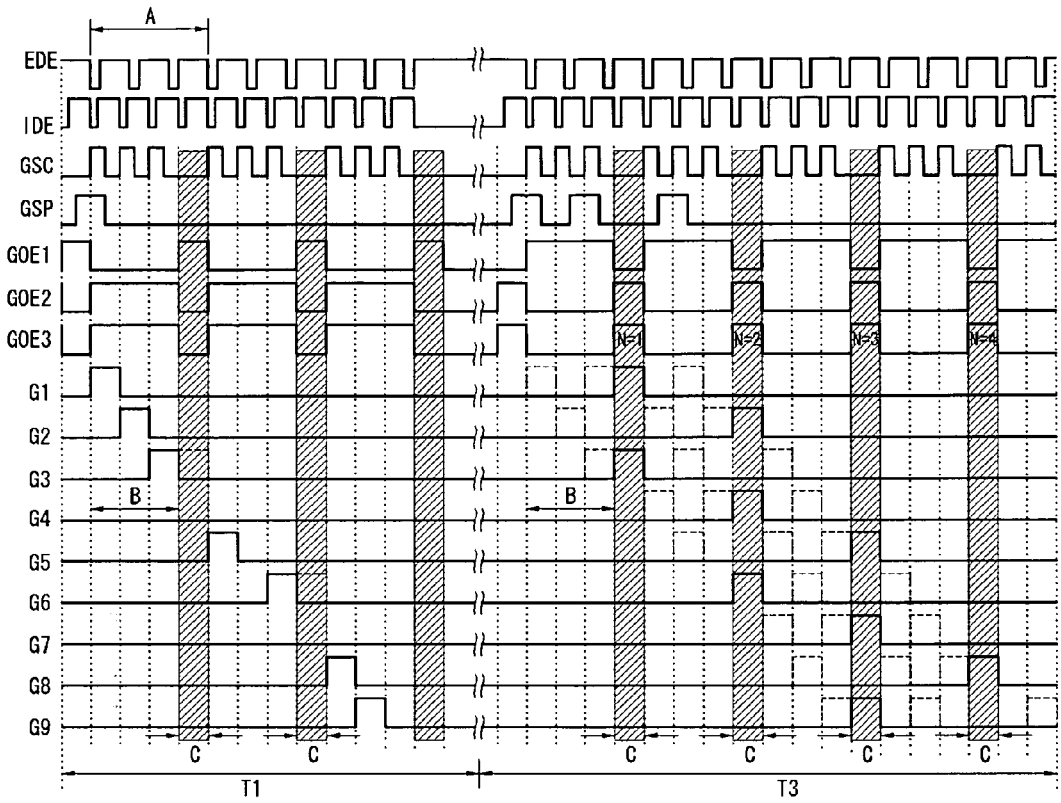
FIG. 11 is a timing diagram showing gate timing control signals and gate pulses of a liquid crystal display according to a first embodiment.
Figure 12:
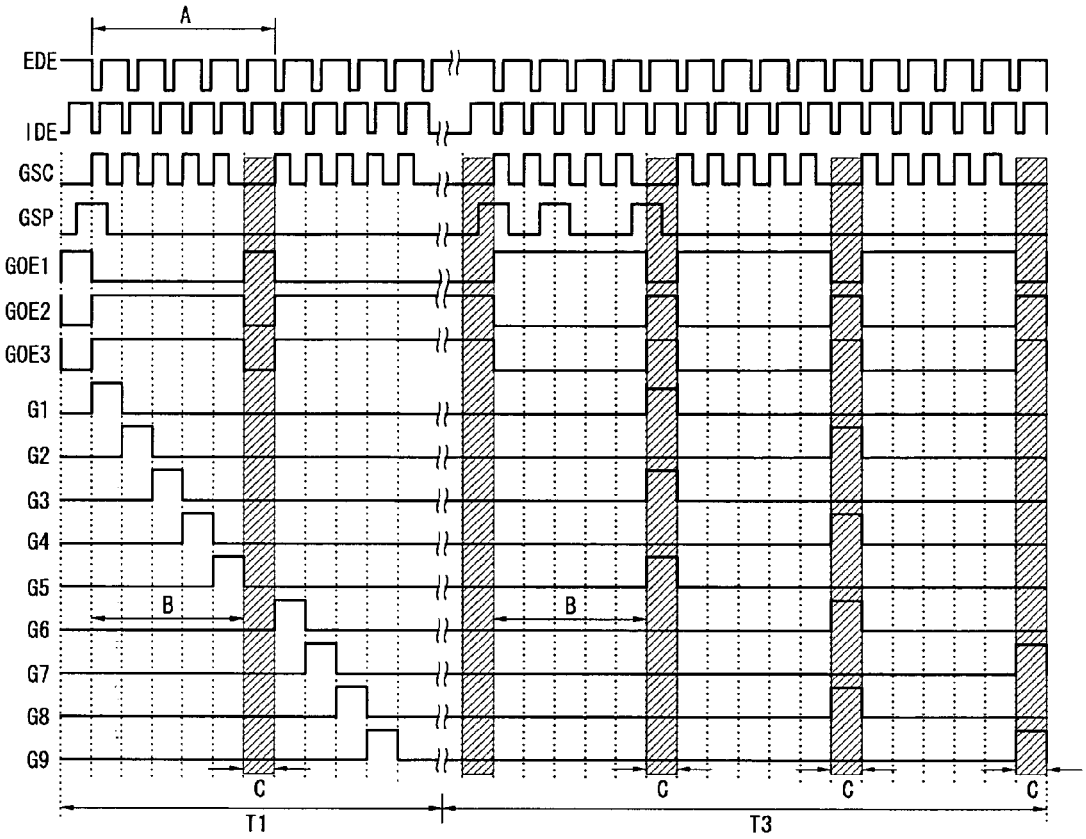
FIG. 12 is a timing diagram showing gate timing control signals and gate pulses of a liquid crystal display according to a second embodiment.
Figure 13:
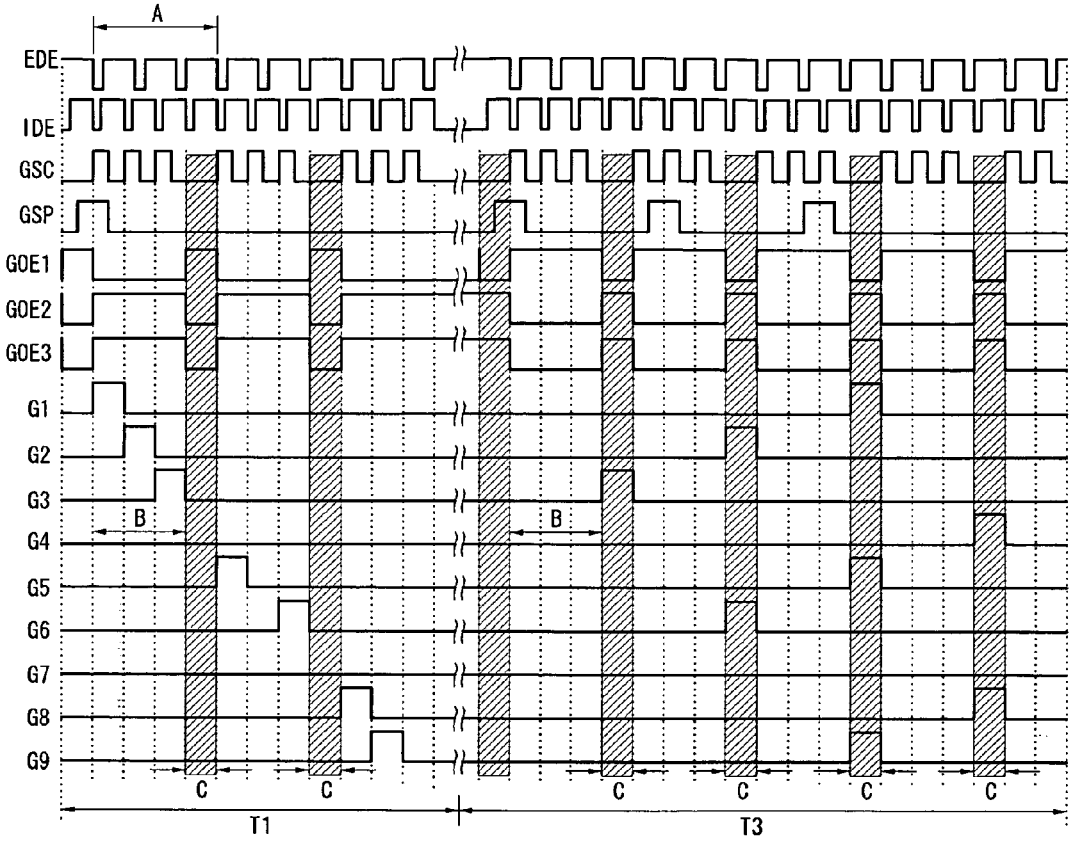
FIG. 13 is a timing diagram showing gate timing control signals and gate pulses of a liquid crystal display according to a third embodiment.

FIGS. 11 to 13 show gate timing control signals and gate pulses of liquid crystal displays according to various embodiments. In FIGS. 11 to 13, only the gate pulses supplied to first to ninth gate lines G1 to G9 will be described, and a description of period T1 will be omitted due to space limitations.

FIG. 11 shows gate timing control signals and gate pulses supplied to a liquid crystal display according to a first embodiment. In FIG. 11, dotted lines denote the outputs shifted by the shift resistors 70 in the gate drive ICs 631 to 633, and the outputs are cut off by gate output enable signals GOE1 to GOE 3. The gate pulses shown as solid lines are applied to the gate lines G1 to G9.

Referring to FIG. 11, the liquid crystal display according to the first embodiment generates an internal data enable signal IDE having a frequency higher than that of an external data enable signal EDE. Moreover, the liquid crystal display according to the first embodiment generates a gate start pulse GSP, a gate shift clock GSC, and gate output enable signals GOE1 to GOE3 based on the internal data enable signal IDE. The gate start pulse GSP is directly applied only to the first gate drive IC 631, and the second and third gate drive ICS 632 and 633 receive a carry signal from the previous gate drive ICs as a gate start pulse. The gate shift clock GSC is commonly input to the gate drive ICS 631 to 633. The gate output enable signals GOE1 to GOE3 are respectively input to the gate drive ICs 631 to 633.

During period T1, the first gate drive IC 631 repeats the operations of sequentially supplying gate pulses, synchronized with the video data voltages from the data driving circuit 62, to three gate lines G1 to G3, and then sequentially supplying the gate pulses to three gate lines G4 to G6 after one horizontal period. The gate start pulse GSP applied to the first gate drive IC 631 is generated only one time simultaneously with the start of period T1. The gate shift clock GSC for controlling the shift operation of the first gate drive IC 631 is generated three times consecutively with a pulse width of one horizontal period for about three horizontal periods and generated three times consecutively again after maintaining a low logic level for about one horizontal period. The first gate output enable signal GOE1 for controlling the output of the first gate drive IC 631 is generated one time with a pulse width of a high logic level for about one horizontal period and maintains a low logic level for about three horizontal periods. The shift resistor 70 of the first gate drive IC 631 shifts the gate start pulse GSP at each rising edge of the gate shift clock GSC, generated three times consecutively, in response to the gate timing control signals. Subsequently, since the gate shift clock GSC maintains a low logic level for about one horizontal period, a third D flip-flop of the shift resistor 70 in the first gate drive IC 631 maintains a high logic level for a fourth horizontal period. During first to third horizontal periods, i.e., during period B, since the first gate output enable signal GOE1 maintains a low logic level, the first gate drive IC 631 sequentially supplies the gate pulses to the first to third gate lines G1 to G3. During the fourth horizontal period, i.e., during period C, since the first gate output enable signal GOE1 is inverted into a high logic level, the output of the AND gate 71 is changed to "0". As a result, even if the output of the third D flip-flop of the shift resistor 70 is "1", the output of the sixth gate line G6 is changed to a low potential voltage Vgl. Like this, the first gate drive IC 631 sequentially supplies the gate pulses to three gate lines during period T1 and then does not output a gate pulse for one horizontal period.

Simultaneously with the start of period T1, the second gate drive IC 632 receives carry signals, generated three times consecutively at different times, from the first gate drive IC 631 as the gate start pulse GSP. During period T1, the second gate drive IC 632 repeats the operations of simultaneously supplying the gate pulses to two gate lines spaced at intervals of one line in response to the second gate output enable signal GOE2, changed to a low logic level only during period C, and then stopping the output in response to the second gate output enable signal GOE2 maintained at a high logic level during period B.

During period T1, the gate shift clock GSC is normally applied to the third gate drive IC 633, and the third gate output enable signal GOE3 having the same phase as the second gate output enable signal GOE2 is applied to the third gate drive IC 633. However, during period T1, no carry signal is input from the second gate drive IC 632 to the third gate drive IC 633. As a result, the liquid crystal cells of the third blocks BL3 maintain the video data voltage charged during period T3 of the previous frame.

During period T1, the pause period of the gate shift clock GSC, in which no pulse is generated temporarily, overlaps the high logic period of the first gate output enable signal GOE1 and the low logic period of the second and third gate output enable signals GOE2 and GOE3.

At the beginning of period T3, while the gate shift clock GSC is generated with the same pattern as the previous one, the gate start pulse GSP applied to the first gate drive IC 631 is changed to three pulses at different times. Each pulse has a pulse width of about one horizontal period. The second pulse is generated after about one horizontal period from the generation of the first pulse, and the third pulse is generated after about two horizontal periods from the generation of the second pulse. During period of T3, the duty ratio of the first gate output enable signal GOE1 is increased compared to that during period T1. The first gate output enable signal GOE1 has a low logic period of about one horizontal period between the pulses that maintain a high logic level for about three horizontal periods. The shift resistor 70 of the first gate drive IC 631 shifts the gate start pulse GSP at each rising edge of the gate shift clock GSC as shown with dotted lines in response to the gate timing control signals. During the shift process, when the gate shift clock GSC maintains a low logic level for about one horizontal period, the shift resistor 70 of the first gate drive IC 631 maintains the previous output. During the first to third horizontal periods, i.e., during period B, since the first gate output enable signal GOE1 maintains a high logic level, there is no output from the first gate drive IC 631. During the fourth horizontal period, i.e., during period C, since the first gate output enable signal GOE1 is inverted into a low logic level, the first gate drive IC 631 simultaneously supplies the gate pulses to the first and third gate lines G1 and G3. Subsequently, during fifth to seventh horizontal periods, i.e., during period B, the first shift resistor 70 of the first gate drive IC 631 continues the shift operation. During the fifth to seventh horizontal periods, the first gate drive IC 631 does not generate an output since the first gate output enable signal GOE1 has a high logic level. During an eighth horizontal period, i.e., during period C, since the first gate output enable signal GOE1 is inverted into a low logic level, the first gate drive IC 631 simultaneously outputs the gate pulses to the second, fourth, and sixth gate lines G2, G4, and G6. Like this, during period T3, the first gate drive IC 631 simultaneously supplies the gate pulses, synchronized with the black voltage from the data driving circuit 62, to two gate lines spaced at intervals of at least one line.

During period T3, the gate shift clock GSC is applied to the second gate drive IC 632, and a second gate output enable signal GOE2 having a small duty ratio is applied to the second gate drive IC 632. During period T3, no carry signal is input from the first gate drive IC 631 to the second gate drive IC 632. As a result, the liquid crystal cells of the second block BL2 maintain the video data voltage charged during period T3 of the previous frame.

During period T3, the third gate drive IC 633 receives a carry signal having only one pulse from the second gate drive IC 632. During period T3, the third gate drive IC 633 repeats the operations of sequentially supplying the gate pulses to three gate lines in response to the third gate output enable signal GOE3, changed to a low logic level during period B, and then stopping the output for one horizontal period.

Meanwhile, during period T2, since the first gate drive IC 631 receives no carry signal from the third gate drive IC 633, no output is generated. As a result, the liquid crystal cells of the first block BL1 maintain the video data voltage charged during period T1.

At the beginning of period T2, the first gate drive IC 631 transmits the same signal as the gate start pulse GSP, which has been applied during period T1, to the second drive IC 632 as a carry signal. During period T2, the second gate output enable signal GOE2 is changed into the form of a pulse having a small duty ratio, whereas, the gate shift clock GSC repeats the same pattern as during period T1. As a result, during period T2, the second gate drive IC 632 repeats the operations of sequentially supplying the gate pulses, synchronized with the video data voltages from the data driving circuit 62, to three gate lines, and then stopping the output for one horizontal period. During period T2, the video data voltage is sequentially applied to each line of the liquid crystal cells in the second block BL2.

At the beginning of period T2, the second gate drive IC 632 transmits three pulses the same as the gate start pulse GSP, applied to the first drive IC 631 during period T3, to the third drive IC 633 as a carry signal. During period T2, the third gate output enable signal GOE3 is generated with the same pattern as period T1, i.e., with pulses having a large duty ratio, and the gate shift clock GSC also repeats the same pattern as period T1. As a result, during period T2, the third gate drive IC 633 simultaneously supplies the gate pulses, synchronized with the black voltage from the data driving circuit 62, to at least two gate lines spaced at intervals of at least one line. During period T2, the black voltage is charged in the liquid crystal cells of the third block BL3.

The order of charging the respective blocks BL1 to BL3 with the black voltage by the scanning operation as shown in FIG. 11 is as follows. If the number of times of generating a gate pulse is "N", the order of charging the respective blocks BL1 to BL3 can be expressed by the following Formula 1:

$$3N+1, 3N+3 (N=0)$$

$$3N-1, 3N+1, 3N+3 (N \geqq 1) \qquad \text{[Formula 1]}$$

FIG. 12 shows gate timing control signals and gate pulses supplied to a liquid crystal display according to a second embodiment. In FIG. 12, the waveforms, blocked by gate output enable signals GOE1 to GOE3, out of the output waveforms shifted by the shift resistors 70 in the gate drive ICs 631 to 633 are omitted.

Referring to FIG. 12, the liquid crystal display according to the second embodiment generates an internal data enable signal IDE having a frequency higher than that of an external data enable signal EDE. Moreover, the liquid crystal display according to the second embodiment generates a gate start pulse GSP, a gate shift clock GSC, and gate output enable signals GOE1 to GOE3 based on the internal data enable signal IDE. The gate start pulse GSP is directly applied only to the first gate drive IC 631, and the second and third gate drive ICS 632 and 633 receive a carry signal from the previous gate drive ICs as a gate start pulse. The gate shift clock GSC is commonly input to the gate drive ICS 631 to 633. The gate output enable signals GOE1 to GOE3 are respectively input to the gate drive ICs 631 to 633.

During period T1, the first gate drive IC 631 repeats the operations of sequentially supplying gate pulses, synchronized with video data voltages from the data driving circuit 62, to five gate lines G1 to G5, and then sequentially supplying the gate pulses to five gate lines G6 to G10 after one horizontal period. The gate start pulse GSP applied to the first gate drive IC 631 has a pulse width of about one horizontal period and is generated only one time simultaneously with the start of period T1. The gate shift clock GSC is generated five times consecutively with a pulse width of one horizontal period for about five horizontal periods and generated five times consecutively again after maintaining a low logic level for about one horizontal period. The first gate output enable signal GOE1 is generated one time with a pulse width of a high logic level for about one horizontal period and maintains a low logic level for about five horizontal periods. The shift resistor 70 of the first gate drive IC 631 shifts the gate start pulse GSP at each rising edge of the gate shift clock GSC, generated five times consecutively, in response to the gate timing control signals. Subsequently, since the gate shift clock GSC maintains a low logic level for about one horizontal period, a fifth D flip-flop of the shift resistor 70 in the first gate drive IC 631 maintains a high logic level for a sixth horizontal period. During first to fifth horizontal periods, i.e., during period B, since the first gate output enable signal GOE1 maintains a low logic level, the first gate drive IC 631 sequentially supplies the gate pulses to the first to fifth gate lines G1 to G5. During the sixth horizontal period, i.e., during period C, since the first gate output enable signal GOE1 is inverted into a high logic level, the output of the AND gate 71 is changed to "0". As a result, even if the output of the fifth D flip-flop of the shift resistor 70 is "1", the output of the fifth gate line G5 is changed to a low potential voltage Vgl during period C. Subsequently, during seventh to tenth horizontal periods, i.e., during period B, since the first gate output enable signal GOE1 maintains a low logic level and the shift operation is normalized by the gate shift clocks GSC, generated five times consecutively, the first gate drive IC 631 sequentially supplies the gate pulses to the sixth to tens gate lines G6 to G10. Like this, the first gate drive IC 631 sequentially supplies the gate pulses to five gate lines during period T1 and then does not output a gate pulse for one horizontal period.

Simultaneously with the start of period T1, the second gate drive IC 632 receives carry signals, generated three times consecutively at different times, from the first gate drive IC 631 as the gate start pulse GSP. During period T1, the second gate drive IC 632 repeats the operations of simultaneously supplying the gate pulses to three or four gate lines spaced at intervals of one line in response to the second gate output enable signal GOE2, changed to a low logic level only during period C, and then stopping the output in response to the second gate output enable signal GOE2 maintained at a high logic level during period B.

During period T1, the gate shift clock GSC is normally applied to the third gate drive IC 633, and the third gate output enable signal GOE3 having the same phase as the second gate output enable signal GOE2 is applied to the third gate drive IC 633. However, during period T1, no carry signal is input from the second gate drive IC 632 to the third gate drive IC 633. As a result, the liquid crystal cells of the third blocks BL3 maintain the video data voltage charged during period T3 of the previous frame.

At the beginning of period T3, while the gate shift clock GSC is generated with the same pattern as the previous one, the gate start pulse GSP applied to the first gate drive IC 631 is changed to three pulses at different times. Each pulse has a pulse width of about one horizontal period. The second pulse is generated after about one horizontal period from the generation of the first pulse, and the third pulse is generated after about two horizontal periods from the generation of the second pulse. During period of T3, the duty ratio of the first gate output enable signal GOE1 is increased compared to that during period T1. The first gate output enable signal GOE1 has a low logic period of about one horizontal period between the pulses that maintain a high logic level for about five horizontal periods. The shift resistor 70 of the first gate drive IC 631 shifts the gate start pulse GSP at each rising edge of the gate shift clock GSC in response to the gate timing control signals. During the shift process, when the gate shift clock GSC maintains a low logic level for about one horizontal period, the shift resistor 70 of the first gate drive IC 631 maintains the previous output. During the first to fifth horizontal periods, i.e., during period B, since the first gate output enable signal GOE1 maintains a high logic level, there is no output from the first gate drive IC 631. During the sixth horizontal period, i.e., during period C, since the first gate output enable signal GOE1 is inverted into a low logic level, the first gate drive IC 631 simultaneously supplies the gate pulses to the first, third, and fifth gate lines G1, G3, and G5. Subsequently, during seventh to eleventh horizontal periods, i.e., during period B, the first shift resistor 70 of the first gate drive IC 631 continues the shift operation. During the seventh to eleventh horizontal periods, the first gate drive IC 631 does not generate an output since the first gate output enable signal GOE1 has a high logic level. During a twelfth horizontal period, i.e., during period C, since the first gate output enable signal GOE1 is inverted into a low logic level, the first gate drive IC 631 simultaneously outputs the gate pulses to the second, fourth, sixth, and eighth gate lines G2, G4, G6, and G8. Like this, during period T3, the first gate drive IC 631 simultaneously supplies the gate pulses, synchronized with the black voltage from the data driving circuit 62, to three or four gate lines spaced at intervals of at least one line.

During period T3, the gate shift clock GSC is applied to the second gate drive IC 632, and a second gate output enable signal GOE2 having a small duty ratio is applied to the second gate drive IC 632. During period T3, no carry signal is input from the first gate drive IC 631 to the second gate drive IC 632. As a result, the liquid crystal cells of the second block BL2 maintain the video data voltage charged during period T3 of the previous frame.

During period T3, the third gate drive IC 633 receives a carry signal having only one pulse from the second gate drive IC 632. During period T3, the third gate drive IC 633 repeats the operations of simultaneously supplying the gate pulses to five gate lines in response to the third gate output enable signal GOE3, changed to a low logic level during period B, and then stopping the output for one horizontal period.

Meanwhile, during period T2, since the first gate drive IC 631 receives no carry signal from the third gate drive IC 633, no output is generated. As a result, the liquid crystal cells of the first block BL1 maintain the video data voltage charged during period T1.

Simultaneously with the start of period T2, the first gate drive IC 631 transmits the same signal as the gate start pulse GSP, which has been applied during period T1, to the second drive IC 632 as a carry signal. During period T2, the second gate output enable signal GOE2 is changed into the form of a pulse having a small duty ratio, whereas, the gate shift clock GSC repeats the same pattern as during period T1. As a result, during period T2, the second gate drive IC 632 repeats the operations of sequentially supplying the gate pulses, synchronized with the video data voltages from the data driving circuit 62, to five gate lines, and then stopping the output for one horizontal period. During period T2, the video data voltage is sequentially applied to each line of the liquid crystal cells in the second block BL2.

Simultaneously with the start of period T2, the second gate drive IC 632 transmits three pulses the same as the gate start pulse GSP, applied to the first drive IC 631 during period T3, to the third drive IC 633 as a carry signal. During period T2, the third gate output enable signal GOE3 is generated with the same pattern as period T1, i.e., with pulses having a large duty ratio, and the gate shift clock GSC also repeats the same pattern as period T1. As a result, during period T2, the third gate drive IC 633 simultaneously supplies the gate pulses, synchronized with the black voltage from the data driving circuit 62, to at least two gate lines spaced at intervals of at least one line. During period T2, the black voltage is charged in the liquid crystal cells of the third block BL3.

The order of charging the respective blocks BL1 to BL3 with the black voltage by the scanning operation as shown in FIG. 12 is as follows. If the number of times of generating a gate pulse is "N", the order of charging the respective blocks BL1 to BL3 can be expressed by the following Formula 2:

$$5N+1, 5N+3, 5N+5 (N=0)$$

$$5N-3, 5N-1, 5N+1, 5N+3, 5N+5 (N \geqq 1) \quad \text{[Formula 2]}$$

FIG. 13 shows gate timing control signals and gate pulses supplied to a liquid crystal display according to a third embodiment. In FIG. 13, the waveforms, blocked by gate output enable signals GOE1 to GOE3, out of the output waveforms shifted by the shift resistors 70 in the gate drive ICs 631 to 633 are omitted.

Referring to FIG. 13, the liquid crystal display according to the third embodiment generates an internal data enable signal IDE having a frequency higher than that of an external data enable signal EDE. Moreover, the liquid crystal display according to the third embodiment generates a gate start pulse GSP, a gate shift clock GSC, and gate output enable signals GOE1 to GOE3 based on the internal data enable signal IDE. The gate start pulse GSP is directly applied only to the first gate drive IC 631, and the second and third gate drive ICS 632 and 633 receive a carry signal from the previous gate drive ICs as a gate start pulse. The gate shift clock GSC is commonly input to the gate drive ICS 631 to 633. The gate output enable signals GOE1 to GOE3 are respectively input to the gate drive ICs 631 to 633.

During period T1, the first gate drive IC 631 repeats the operations of sequentially supplying gate pulses, synchronized with video data voltages from the data driving circuit 62, to three gate lines G1 to G3, and then sequentially supplying the gate pulses to three gate lines G4 to G6 after one horizontal period. The gate start pulse GSP applied to the first gate drive IC 631 has a pulse width of about one horizontal period and is generated only one time simultaneously with the start of period T1. The gate shift clock GSC is generated three times consecutively with a pulse width of one horizontal period for about three horizontal periods and generated three times consecutively again after maintaining a low logic level for about one horizontal period. The first gate output enable signal GOE1 is generated one time with a pulse width of a high logic level for about one horizontal period and maintains a low logic level for about three horizontal periods. The shift resistor 70 of the first gate drive IC 631 shifts the gate start pulse GSP at each rising edge of the gate shift clock GSC, generated three times consecutively, in response to the gate timing control signals. Subsequently, since the gate shift clock GSC maintains a low logic level for about one horizontal period, the third D flip-flop of the shift resistor 70 in the first gate drive IC 631 maintains a high logic level for a fourth horizontal period. During first to third horizontal periods, i.e., during period B, since the first gate output enable signal GOE1 maintains a low logic level, the first gate drive IC 631 sequentially supplies the gate pulses to the first to third gate lines G1 to G3. During the fourth horizontal period, i.e., during period C, since the first gate output enable signal GOE1 is inverted into a high logic level, the output of the AND gate 71 is changed to "0". As a result, even if the output of the third D flip-flop of the shift resistor 70 is "1", the voltage of the third gate line G3 is changed to a low potential voltage Vgl during period C. Subsequently, during fifth to seventh horizontal periods, i.e., during period B, since the first gate output enable signal GOE1 maintains a low logic level and the shift operation is normalized by the gate shift clocks GSC, generated three times consecutively, the first gate drive IC 631 sequentially supplies the gate pulses to the fourth to sixth gate lines G4 to G6. Like this, the first gate drive IC 631 sequentially supplies the gate pulses to three gate lines during period T1 and then does not output a gate pulse for one horizontal period.

Simultaneously with the start of period T1, the second gate drive IC 632 receives carry signals, generated three times consecutively at different times of about four horizontal periods, from the first gate drive IC 631 as the gate start pulse GSP. During period T1, the second gate drive IC 632 repeats the operations of supplying the gate pulse to the third gate line in the second block BL2, simultaneously supplying the gate pulses to two or three gate lines spaced at intervals of one line in response to the second gate output enable signal GOE2, changed to a low logic level only during period C, and then stopping the output in response to the second gate output enable signal GOE2 maintained at a high logic level during period B.

During period T1, the gate shift clock GSC is normally applied to the third gate drive IC 633, and the third gate output enable signal GOE3 having the same phase as the second gate output enable signal GOE2 is applied to the third gate drive IC 633. However, during period T1, no carry signal is input from the second gate drive IC 632 to the third gate drive IC 633. As a result, the liquid crystal cells of the third blocks BL3 maintain the video data voltage charged during period T3 of the previous frame.

At the beginning of period T3, while the gate shift clock GSC is generated with the same pattern as the previous one, the gate start pulse GSP applied to the first gate drive IC 631 has three pulses generated consecutively at different times of about four horizontal periods. Each pulse has a pulse width of about one horizontal period. The second pulse is generated after about four horizontal periods from the generation of the first pulse, and the third pulse is generated after about four horizontal periods from the generation of the second pulse. During period of T3, the duty ratio of the first gate output enable signal GOE1 is increased compared to that during period T1. The first gate output enable signal GOE1 has a low logic period of about one horizontal period between the pulses that maintain a high logic level for about three horizontal periods. The shift resistor 70 of the first gate drive IC 631 shifts the gate start pulse GSP at each rising edge of the gate shift clock GSC in response to the gate timing control signals. During the shift process, when the gate shift clock GSC maintains a low logic level for about one horizontal period, the shift resistor 70 of the first gate drive IC 631 maintains the previous output. During the first to third horizontal periods, i.e., during period B, since the first gate output enable signal GOE1 maintains a high logic level, there is no output from the first gate drive IC 631. During the fourth horizontal period, i.e., during period C, since the first gate output enable signal GOE1 is inverted into a low logic level, the first gate drive IC 631 supplies the gate pulse to the third gate line G3. During fifth to seventh horizontal periods, i.e., during period B, the first shift resistor 70 of the first gate drive IC 631 continues the shift operation. During the fifth to seventh horizontal periods, the first gate drive IC 631 does not generate an output since the first gate output enable signal GOE1 has a high logic level. During an eighth horizontal period, i.e., during period C, since the first gate output enable signal GOE1 is inverted into a low logic level, the first gate drive IC 631 simultaneously outputs the gate pulses to the second and sixth gate lines G2 and G6. During ninth to eleventh horizontal periods, the shift resistor 70 of the first gate drive IC 631 continues the shift operation. During the ninth to eleventh horizontal periods, the first gate drive IC 631 does not generate an output since the first gate output enable signal GOE1 has a high logic level. During a twelfth horizontal period, since the first gate output enable signal GOE1 is inverted into a low logic level, the first gate drive IC 631 simultaneously outputs the gate pulses to the first, fifth, and ninth gate lines G1, G5, and G9. Like this, during period T3, the first gate drive IC 631 simultaneously supplies the gate pulses, synchronized with the black voltage from the data driving circuit 62, to two or three gate lines spaced at intervals of at least one line.

During period T3, the gate shift clock GSC is applied to the second gate drive IC 632, and a second gate output enable signal GOE2 having a small duty ratio is applied to the second gate drive IC 632. During period T3, no carry signal is input from the first gate drive IC 631 to the second gate drive IC 632. As a result, the liquid crystal cells of the second block BL2 maintain the video data voltage charged during period T3 of the previous frame.

During period T3, the third gate drive IC 633 receives a carry signal having only one pulse from the second gate drive IC 632. During period T3, the third gate drive IC 633 repeats the operations of simultaneously supplying the gate pulses to five gate lines in response to the third gate output enable signal GOE3, changed to a low logic level during period B, and then stopping the output for one horizontal period.

Meanwhile, during period T2, since the first gate drive IC 631 receives no carry signal from the third gate drive IC 633, no output is generated. As a result, the liquid crystal cells of the first block BL1 maintain the video data voltage charged during period T1.

Simultaneously with the start of period T2, the first gate drive IC 631 transmits the same signal as the gate start pulse GSP, which has been applied during period T1, to the second drive IC 632 as a carry signal. During period T2, the second gate output enable signal GOE2 is changed into the form of a pulse having a small duty ratio, whereas, the gate shift clock GSC repeats the same pattern as during period T1. As a result, during period T2, the second gate drive IC 632 repeats the operations of sequentially supplying the gate pulses, synchronized with the video data voltages from the data driving circuit 62, to three gate lines, and then stopping the output for one horizontal period. During period T2, the video data voltage is sequentially applied to each line of the liquid crystal cells in the second block BL2.

Simultaneously with the start of period T2, the second gate drive IC 632 transmits three pulses the same as the gate start pulse GSP, applied to the first drive IC 631 during period T3, to the third drive IC 633 as a carry signal. During period T2, the third gate output enable signal GOE3 is generated with the same pattern as period T1, i.e., with pulses having a large duty ratio, and the gate shift clock GSC also repeats the same pattern as period T1. As a result, during period T2, the third gate drive IC 633 simultaneously supplies the gate pulses, synchronized with the black voltage from the data driving circuit 62, to at least two gate lines spaced at intervals of at least one line. During period T2, the black voltage is charged in the liquid crystal cells of the third block BL3.

The order of charging the respective blocks BL1 to BL3 with the black voltage by the scanning operation as shown in FIG. 13 is as follows. If the number of times of generating a gate pulse is "N", the order of charging the respective blocks BL1 to BL3 can be expressed by the following Formula 3:

$$3N+3(N=0)$$

$$3N-1,3N+3(N=1)$$

$$3n-5,3N-1,3N+3(N\geqq 1) \qquad \text{[Formula 3]}$$

As described above, the liquid crystal display and the driving method thereof according to the exemplary embodiments can simultaneously supply gate pulses to at least two gate lines spaced at intervals of at least one line by controlling the gate timing control signals. Accordingly, the liquid crystal display and the driving method thereof according to the exemplary embodiments can simultaneously supply gate pulses to at least two gate lines in the block, to which the black voltage is applied, even if any gate drive IC is used.

What is claimed is:

1. A liquid crystal display comprising:

a liquid crystal display panel on which a plurality of data lines and a plurality of gate lines cross each other;

a data driving circuit for supplying a video data voltage and a black voltage to the data lines;

a plurality of gate drive integrate circuits for sequentially supplying a gate pulse, synchronized with the video data voltage during a first period, to adjacent gate lines, and then simultaneously supplying a gate pulse, synchronized with the black voltage during a second period, to the gate lines spaced at intervals of one line; and a timing controller for generating data timing control signals for controlling the data driving circuit and gate timing control signals for controlling the gate drive integrate circuits, wherein the gate timing control signals include:

a first gate start pulse generated only one time at the beginning of the first period and starting the shift operation of the gate drive integrate circuits;

a second gate start pulse including a first pulse, a second pulse, and a third pulse continuously generated at the beginning of the second period and making the shift operation of the gate drive integrate circuits to be started, wherein a time difference between the second pulse and the third pulse of the second gate start pulse is more than that between the first pulse and the second pulse of the second gate start pulse;

a first gate output enable signal generated during the first period, having a low logic period longer than a high logic period, and controlling the output of the gate drive integrate circuits;

a second gate output enable signal generated during the second period, having a phase opposite to that of the first gate output enable signal, and controlling the output of the gate drive integrate circuits; and a gate shift clock having a pulse group including pulses generated more than three times and a pause period longer than the interval between the pulses and controlling the shift operation of the gate drive integrate circuits.

2. The liquid crystal display of claim 1, wherein the timing controller generates an internal data enable signal having a frequency higher than that of an external data enable signal, supplies digital video data, sampled based on the internal data enable signal, to the data driving circuit, and generates the data timing control signals and the gate timing control signals based on the internal data enable signal.

3. The liquid crystal display of claim 1, wherein the pause period of the gate shift clock overlaps a high logic period of the first gate output enable signal and a low logic period of the second gate output enable signal.

4. The liquid crystal display of claim 3, wherein the gate output enable signals are respectively supplied to the gate drive integrate circuits.

5. The liquid crystal display of claim 4, wherein the first gate output enable signal is supplied to one of the gate drive integrate circuits and, at the same time, the second gate output enable signal is supplied to other gate drive integrate circuits.

6. A method of driving a liquid crystal display comprising a liquid crystal display panel on which a plurality of data lines and a plurality of gate lines cross each other, the method comprising:

generating data timing control signals for controlling a data driving circuit and gate timing control signals for controlling a gate drive integrate circuits;

supplying a video data voltage and a black voltage to the data lines;

sequentially supplying a gate pulse, synchronized with the video data voltage and the black voltage, to adjacent gate lines during a first period; and simultaneously supplying a gate pulse, synchronized with the black voltage, to the gate lines spaced at intervals of one line during a second period, wherein the gate timing control signals include:

a first gate start pulse generated only one time at the beginning of the first period and starting the shift operation of the gate drive integrate circuits;

a second gate start pulse including a first pulse, a second pulse, and a third pulse continuously generated at the beginning of the second period and making the shift operation of the gate drive integrate circuits to be started, wherein a time difference between the second pulse and the third pulse of the second gate start pulse is more than that between the first pulse and the second pulse of the second gate start pulse;

a first gate output enable signal generated during the first period, having a low logic period longer than a high logic period, and controlling the output of the gate drive integrate circuits;

a second gate output enable signal generated during the second period, having a phase opposite to that of the first gate output enable signal, and controlling the output of the gate drive integrate circuits; and a gate shift clock having a pulse group including pulses generated more than three times and a pause period longer than the interval between the pulses and controlling the shift operation of the gate drive integrate circuits.

7. A liquid crystal display comprising:

a liquid crystal display panel on which a plurality of data lines and a plurality of gate lines cross each other;

a data driving circuit for supplying a video data voltage and a black voltage to the data lines;

a plurality of gate drive integrate circuits for sequentially supplying a gate pulse, synchronized with the video data voltage during a first period, to adjacent gate lines, and then simultaneously supplying a gate pulse, synchronized with the black voltage during a second period, to the gate lines spaced at intervals of three lines, and a timing controller for generating data timing control signals for controlling the data driving circuit and gate timing control signals for controlling the gate drive integrate circuits, wherein the gate timing control signals comprise:

a first gate start pulse generated only one time at the beginning of the first period and starting the shift operation of the gate drive integrate circuits;

a second gate start pulse including a first pulse, a second pulse, and a third pulse continuously generated at the beginning of the second period and making the shift operation of the gate drive integrate circuits to be started;

a first gate output enable signal generated during the first period, having a low logic period longer than a high logic period, and controlling the output of the gate drive integrate circuits;

a second gate output enable signal generated during the second period, having a phase opposite to that of the first gate output enable signal, and controlling the output of the gate drive integrate circuits; and a gate shift clock having a pulse group including pulses generated more than three times and a pause period longer than the interval between the pulses and controlling the shift operation of the gate drive integrate circuits.

8. A method of driving a liquid crystal display comprising a liquid crystal display panel on which a plurality of data lines and a plurality of gate lines cross each other, the method comprising:

generating data timing control signals for controlling a data driving circuit and gate timing control signals for controlling a gate drive integrate circuits;

supplying a video data voltage and a black voltage to the data lines;

sequentially supplying a gate pulse, synchronized with the video data voltage and the black voltage, to adjacent gate lines during a first period; and simultaneously supplying a gate pulse, synchronized with the black voltage, to the gate lines spaced at intervals of three lines during a second period, wherein the gate timing control signals comprise:

a first gate start pulse generated only one time at the beginning of the first period and starting the shift operation of the gate drive integrate circuits;

a second gate start pulse including a first pulse, a second pulse, and a third pulse continuously generated at the beginning of the second period and making the shift operation of the gate drive integrated circuits to be started;

a first gate output enable signal generated during the first period, having a low logic period longer than a high logic period, and controlling the output of the gate drive integrate circuits;

a second gate output enable signal generated during the second period, having a phase opposite to that of the first gate output enable signal, and controlling the output of the gate drive integrate circuits; and a gate shift clock having a pulse group including pulses generated more than three times and a pause period longer than the interval between the pulses and controlling the shift operation of the gate drive integrate circuits.

* * * * *